US006029723A

United States Patent [19]

Baquero et al.

[11] Patent Number: 6,029,723

[45] Date of Patent: Feb. 29, 2000

[54] INTERCHANGEABLE PURSE

[76] Inventors: Rebecca M. Baquero; Steven J. Baquero, both of 3842 Holland Dr., Lithonia, Ga. 30058

[21] Appl. No.: 09/167,694

[22] Filed: Oct. 7, 1998

[51] Int. Cl.[7] ..... A45C 3/08

[52] U.S. Cl. ..... 150/105

[58] Field of Search ..... 150/103, 104, 150/105, 107, 118, 119

[56] References Cited

U.S. PATENT DOCUMENTS

| | | | |
|---|---|---|---|
| D. 164,621 | 9/1951 | Bienen | 150/105 X |
| 1,978,971 | 10/1934 | Thornhill et al. | 150/105 X |
| 2,087,951 | 7/1937 | Jarvis | 150/112 X |
| 2,118,400 | 5/1938 | Goldberg | 150/105 |
| 2,609,854 | 9/1952 | Rosen | 150/104 X |
| 2,694,427 | 11/1954 | Hovis | 150/105 |
| 2,723,696 | 11/1955 | Kase | 150/105 |
| 2,809,685 | 10/1957 | Lowy . | |
| 2,883,041 | 4/1959 | Pfeifer et al. | 206/541 |
| 3,182,701 | 5/1965 | Ginsburg . | |
| 3,234,985 | 2/1966 | Gilbert . | |
| 3,556,187 | 1/1971 | Speakes . | |
| 4,068,786 | 1/1978 | Taniguchi | 150/33 |
| 4,679,242 | 7/1987 | Brockhaus | 150/107 X |
| 4,716,947 | 1/1988 | Haddock | 150/106 |
| 4,856,570 | 8/1989 | Rushing et al. | 150/107 |
| 4,907,633 | 3/1990 | Eckstein . | |
| 5,503,204 | 4/1996 | Byers et al. . | |

FOREIGN PATENT DOCUMENTS

| | | | |
|---|---|---|---|
| 0648544 | 1/1951 | United Kingdom | 150/105 |

*Primary Examiner*—Gary E. Elkins
*Assistant Examiner*—Tri M. Mai
*Attorney, Agent, or Firm*—Henderson & Sturm LLP

[57] ABSTRACT

A purse system comprising a purse housing having a plurality of fasteners on the exterior surface thereof that work in connection with a variety of cover members that snap-fit to the housing. In addition, a variety of straps and strap assemblies are also securable to the housing.

1 Claim, 1 Drawing Sheet

INTERCHANGEABLE PURSE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of ladies' handbags or purses, and more particularly to a purse having interchangeable outer covers.

2. Description of Related Art

As can be seen by reference to the following U.S. Pat. Nos. 5,503,204; 4,907,633; 3,556,187; 3,234,985; 3,182,701; 2,809,685; the prior art is replete with myriad and diverse ladies' purses with interchangeable components.

While all of the aforementioned prior art constructions are more than adequate for the basic purpose and function for which they have been specifically designed, they are uniformly deficient with respect to their failure to provide a simple, efficient, and practical interchangeable purse.

As a consequence of the foregoing situation, there has existed a longstanding need for a new and improved interchangeable purse and the provision of such a construction is a stated objective of the present invention.

BRIEF SUMMARY OF THE INVENTION

Briefly stated, the present invention provides a purse system comprising a purse housing having a plurality of fasteners on the exterior surface thereof that work in connection with a variety of cover members that snap-fit to the housing. In addition, a variety of straps and strap assemblies are also securable to the housing.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
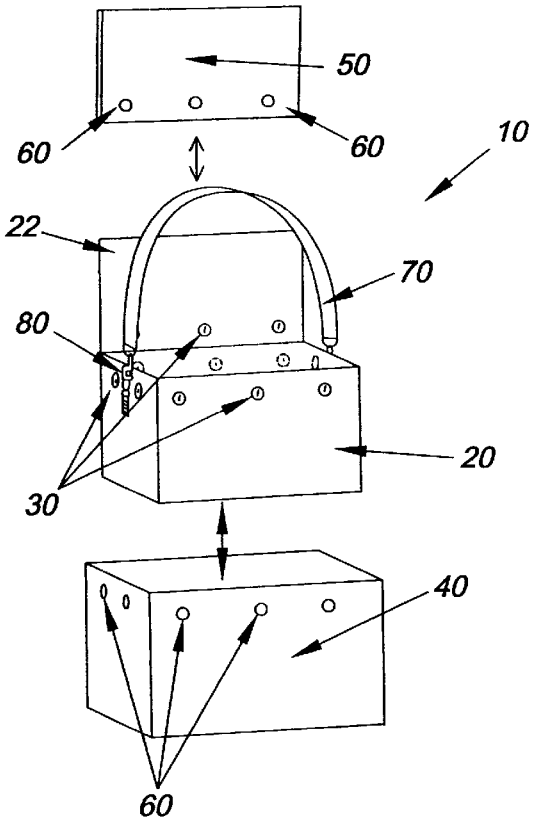
FIG. 1 is an exploded perspective view of the interchangeable purse of the present invention.
Figure 2:
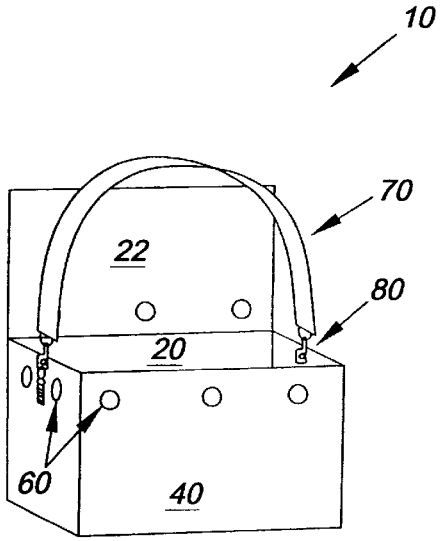
FIG. 2 is a perspective view of an assembled purse.

As can be seen by reference to the drawings, and in particularly to FIG. 1, the interchangeable purse that forms the basis of the present invention is designated generally by the reference number 10.

The interchangeable purse 10 is a trendy box shaped purse housing 20 and flap 22 fabricated of plastic, with a series of incorporated snaps 30 that allow the outer slip cover 40 and lid 50 of the purse to be removed and replaced with a slip cover 40 and lid 50 of a different color or pattern. The covers 40 and lids 50 have the mating snaps 60 attached. The strap

70 attaches between the outer cover 40 and the main housing 20 of the purse by means of a ring and hook device 80, allowing it to also be interchanged when the outer cover 40 and lid 50 are replaced. The interchangeable purse 10 may also feature a built-in mirror on the inside of the lid cover. The interchangeable purse 10 replacement covers 40 would be sold separately, allowing the user to choose the colors and patterns they required to match their particular outfits. As an option, a matching change purse could be included with the purse cover kits. The interchangeable purse 10 could also be designed with pockets in the interior or on the underside of the lid cover. The replaceable covers 40 and lids 50 could be fabricated of plastic, fabric, or leather.

In use, the user purchases the basic interchangeable purse 10, and those replacement covers 40 and lids 50 desired to match their favorite outfits. They would then enjoy the benefit of having a very attractive, trendy purse that could be easily modified at will to coordinate with the outfit that they are wearing that day by simply removing the strap 70 and unsnapping the lid 50 and main body slip covers 40, and replacing these items with those desired. Use of the interchangeable purse 10 provides a very practical and easy-to-use method of allowing anyone to have a purse for every outfit at a fraction of the cost of buying a separate purse for each.

When looking at all of the different purses, women may wish that they had a purse to match all of their outfits; but, they realize that it would cost a fortune to buy all of the purses that they would need. The interchangeable purse 10 of the present invention allows women to easily change the look of the purse completely. The combinations are unlimited at a fraction of the cost.

The interchangeable purse 10 is a standard type purse that would feature snap-on slip covers 40, a snap-on lid 50, and a hook-on strap 70, allowing the user to change the color or pattern of the purse as desired so as to match the outfit being worn that day.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

We claim:

1. An interchangeable purse, consisting of:

a purse housing including an open top compartment with a pivotally attached flap member;

a plurality of snap fasteners carried on the housing and on the flap member;

an outer slip cover disposed to matingly receive the housing, the slip cover including a plurality of mating snap fasteners in registry with the snap fasteners carried on the housing;

a lid member disposed to matingly overlie the flap member, the lid member including a plurality of mating snap fasteners carried on the flap member, whereby the outer slip cover and lid member may be selectively attached to or removed from the housing and flap member;

an interchangeable strap selectively attached to the housing, wherein the strap is attached by a ring and hook device;

wherein the snap fasteners carried on the housing are positioned adjacent an upper edge of the housing; and wherein the snap fasteners are symmetrically spaced.

* * * * *